United States Patent [19]

Awbrey

[11] Patent Number: 5,011,438

[45] Date of Patent: Apr. 30, 1991

[54] METHOD FOR MANUFACTURING IMPROVED ELECTRICAL CONNECTOR

[75] Inventor: Jerry R. Awbrey, Winder, Ga.

[73] Assignee: Esoteric Audio USA, Inc., Winder, Ga.

[21] Appl. No.: 442,052

[22] Filed: Nov. 28, 1989

[51] Int. Cl.[5] ..... H01R 13/00

[52] U.S. Cl. ..... 439/825

[58] Field of Search ..... 439/825

[56] References Cited

U.S. PATENT DOCUMENTS

| | | | |
|---|---|---|---|
| 2,517,677 | 8/1950 | Kjell-Berger et al. | 439/825 |
| 2,780,792 | 2/1957 | Earl | 439/825 |
| 3,092,430 | 6/1963 | Miller | 439/825 |
| 3,391,567 | 7/1968 | Gregory | 439/825 |

*Primary Examiner*—Joseph H. McGlynn
*Attorney, Agent, or Firm*—Jones, Askew & Lunsford

[57] ABSTRACT

A banana plug of unitary construction with an improved spring fit and superior spring and fatigue resistant characteristics. The tip portion of the plug which provides electrical contact is formed from a plurality of slightly arched tangs formed around a longitudinal axis. The method of construction includes the steps of milling the tip as a solid cylindrical piece, tapping same along its longitudinal axis, and providing a plurality of cuts in planes passing through the longitudinal axis. The tangs are then suequentially forced apart and crimped back together at their distal ends by a specially constructed tool.

11 Claims, 2 Drawing Sheets

METHOD FOR MANUFACTURING IMPROVED ELECTRICAL CONNECTOR

FIELD OF INVENTION

The present invention relates to electrical connectors, and more particularly discloses a male connector of unitary construction which provides an improved spring action fit due to its uniquely formed elongated tip.

BACKGROUND OF THE INVENTION

Today, very few homes are without an audio and/or a video component system comprised of several electronic components. Such components possess input and output receptacles for wiring the components together into an audio and/or video system. These input and output receptacles are standardized to allow maximum compatibility among and between the video and/or audio components. Also, electronic test equipment contains the same standardized input and output receptacles for ease of testing and to allow compatibility with other test equipment. These receptacles are most often hollow, cylindrical recesses. They receive a male electrical connector commonly known as a banana plug.

There are currently two common types of banana plugs available. The first is a cylindrical piece of metal with two intersecting cuts passing through the entire length of the banana plug tip. While simple and relatively inexpensive to manufacture, the first type of banana plug suffers from a disadvantage. This type of connector provides electrical contact only at the end of the tip because of the uniform tip diameter and the limited spring action of the design.

Efforts to increase the area of electrical contact between male and female connectors led to a second design for banana connectors. This design features a metal tip covered by a second piece of metal. The thin second piece of metal is cut in the shape of a cross. The center of the cross is placed over the end of the connector tip and the arms of the cross are bent down along the length of the tip. The resulting connector budges slightly at the midpoint, providing some spring action and increased electrical contact area. This design also has several disadvantages. The additional steps of covering the connector shaft with a second piece of metal increases manufacturing costs. Also, unless a relatively expensive alloy such as berylium copper or phosphor bronze is used, the thin second piece of metal eventually becomes fatigued and loses its spring action, thereby reducing the reliability of the electrical contact.

SUMMARY OF THE INVENTION

The present invention comprises an elongated tip adjoining a body at one end. The alignment of the elongated tip with respect to the body defines a characteristic longitudinal axis. The roughly cylindrical elongated tip is formed by a multiplicity of tangs which extend from the body at one end to surround a hollow bore. In a first preferred embodiment, four tangs surround a bore whose center is colinear with the characteristic longitudinal axis and which passes through the entire length of the elongated tip.

The tangs bow giving the tip its spring action and causing the tip diameter to vary along its length. At midpoint, the tip's diameter reaches a maximum that is larger than the diameter of the tip's companion female connector. The tip's spring action allows the male connector to securely mate to the smaller female connector or receptacle.

The body of the electrical connector from which the elongated tip extends may take any convenient form. The preferred embodiment of the invention has a body comprising two portions: a shoulder portion and a barrel portion. The shoulder portion adjoins the elongated tip at one end and the barrel portion at a second end. The diameter of the shoulder portion increases constantly from its smallest where it joins the elongated tip to its largest where it joins the barrel portion. At the barrel portion, the body diameter remains constant.

Embodiments of the connector body that allow the present invention to mate to other male electrical connectors has a second longitudinal bore hole which extends from the rear end of the connector body toward the elongated tip. Preferably, the center line of this hole is colinear to the longitudinal axis of the connector.

The preferred embodiment has a rear longitudinal bore hole consisting of two distinct segments. The first segment extends from the rear end of the connector to the second hole segment. The interior surface of the first segment is smooth and its diameter is larger than that of the second hole segment. The second hole segment extends from the first segment toward the elongated tip. The interior surface of the second segment is threaded. This embodiment allows the present invention to mate with screw type connectors.

In a second embodiment, the rear longitudinal bore hole is smooth and of a uniform diameter. This embodiment allows other banana plugs to mate to the present invention.

In the preferred embodiment, another hole is bored in the connector body along a radial axis. This hole allows other male connectors to mate with the present invention in a plane perpendicular to the characteristic longitudinal axis. The radial hole allows convenient connection when space is limited.

A portion of the outer surface of the connector body is knurled in the preferred embodiment. Knurling increases the attractiveness of the invention and the ease with which it may be gripped.

Because of the construction of the present invention which allows for increased spring action, the elongated tip of the present invention makes contact along the length of the elongated tip as well as at its tip end. The present invention also reduces manufacturing costs in two ways. First, only one piece of metal per connector need be formed. Secondly, relatively cheap metals, such as brass, may be used because the strength of the invention's spring action depends not only on the strength of the material used, but also upon the length, bow and thickness of the elongated tip's tangs.

The present invention is manufactured by first selecting a metal slug, preferably of brass. Metal is then removed from one end of the slug, thereby creating an elongated cylindrical tip extending from a thicker connector body. Metal should be removed such that the resultant form possesses a characteristic longitudinal axis. Beginning at the end of the elongated tip and boring toward the connector body, a hole is formed in the elongated tip. Preferably, the center of the hole is bored colinear to the characteristic longitudinal axis of the connector and extends through the entire length of the elongated tip. Next, the tangs are formed by making at least one longitudinal cut through the elongated tip surface; the number of resulting tangs equals twice the number of cuts. In the first preferred embodiment, two intersecting cuts are made at right angles to each other, resulting in four tangs having arcs of approximately 90 degrees each. Preferably, the line of intersection between the two cuts is colinear to the characteristic longitudinal axis.

The tip's spring action is created by bowing the tangs outward. A special tool is used to create the bow. The tool consists of a shaft attached at one end to a bell shaped member. The other end of the tool's shaft is free and tapers to a tip. This tapered end is inserted into the hollow bore formed by the tangs. As the tool moves down the bore hole, the tool's tapered tip forces the plug's tangs apart. Following behind the tapered end, the bell member forces the tangs back together, though not as close as in the tool's insertion. The tip of the electrical connector is finished by inserting and removing it from a cylindrical shaped recess with a diameter slightly smaller than that of the elongated tip. In practice, a female connector is used.

Alternate methods of manufacturing the preferred and other embodiments of the connector body will suggest themselves to those skilled in the art.

Therefore, generally stated, it is the object of the present invention to overcome the drawbacks in prior art banana plugs recited above.

More specifically, it is an object of the present invention to provide a banana plug which provides electrical contact not only at the end of the plugs' tip, but also at all points along the tangs of the elongated tip of the plug and thereby provide better electrical contact between the present invention and a female receptacle into which it is inserted.

Another object of the present invention is to provide a banana plug with increased spring action in its tangs such that, over the life of the banana plug, the male banana plug will firmly seat itself inside the female receptacle so it will not become loose or fall out.

A still further object of the present invention is to provide a knurled banana plug, where such knurling appears on the body portion of the plug and increases the ability to grip the plug and adds to the aesthetic look of the plug.

A further object of the present invention is to provide a banana plug adapter device so that the preferred embodiment of the present invention may be used as an adapter for fatigued plugs or banana plugs of less reliable conductivity.

Another object of the present invention is to provide a threaded portion of the bore hole in the body portion of the plug such that the plug, when acting as an adapter may receive threaded male plugs.

A further object of the present invention is to decrease manufacturing costs.

It is a further object of the present invention to provide a banana plug with increased electrical contact area without the addition of a second piece of metal for electrical conduction added to the tangs of the banana plug. By decreasing the metals used in manufacturing, the cost of manufacture is decreased.

It is also an object of the present invention to provide a banana plug with increased electrical contact area without the use of an expensive alloy such as berylium copper or phosphor bronze. The present invention utilizes brass throughout and is formed from a cylindrical brass slug which may be obtained inexpensively.

A further object of the present invention is to decrease the number of manufacturing steps by providing a design of unitary construction formed from a single cylindrical metal slug.

A further object of the present invention is to provide a unique manufacturing tool which aids in the ease of manufacturing the present invention by, after one insertion and removal of the plug after rough manufacture, the tangs will form the shape of the preferred embodiment of the present invention.

That the present invention satisfies these objects, and overcomes the drawbacks of the prior art, will be appreciated from the detailed description of the preferred embodiment below.

DETAILED DESCRIPTION

Figure 1:
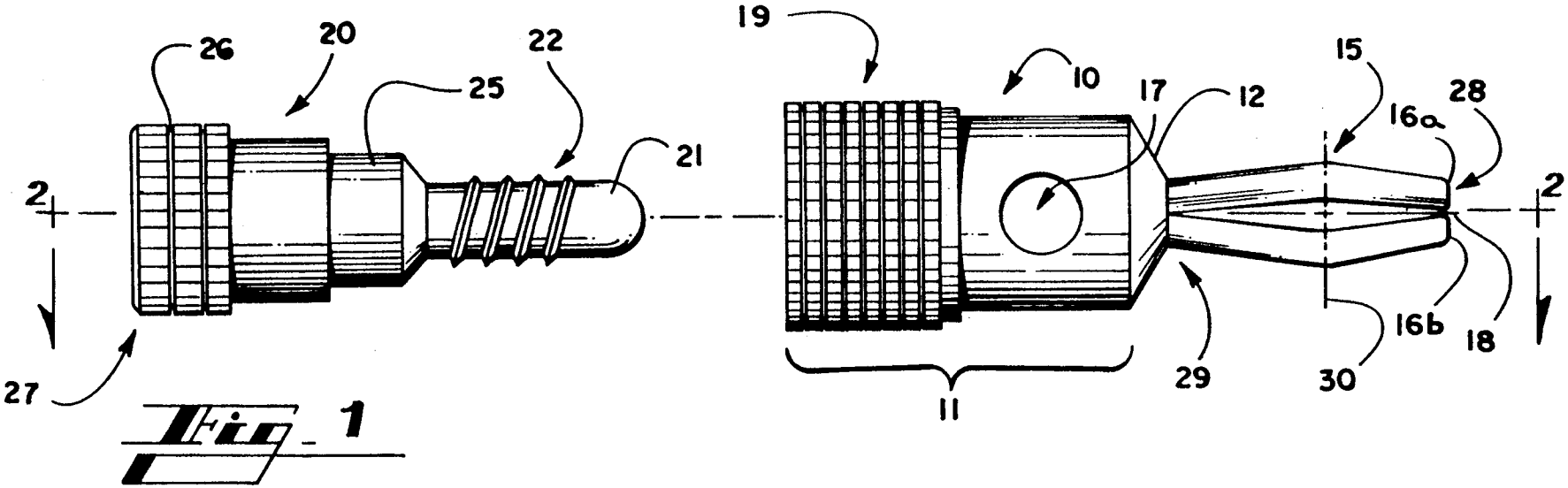
FIG. 1 is a side elevational view of the preferred embodiment of the apparatus of the present invention.

Turning now to the drawing figures which like numerals denote like parts, the preferred embodiment of the apparatus and method of construction of the present invention will now be described. FIG. 1 shows a side elevational view of the banana plug 10 of the preferred embodiment of the present invention. Generally, the banana plug includes a body portion, the limits of which are indicated by brace referenced by the numeral 11 in the drawing figure. A shoulder portion 12 and an elongated tip portion 15 are the other main elements of the structure. Elongated tip 15 includes four tangs **16*a* through 16*d*, two each of which are visible in FIGS. 1 and 2. Shoulder portion 12 joins elongated tip 15 to body portion 11 of banana plug 10**.

In the preferred embodiment a hole 17 is tapped through body portion 11 and extends radially from characteristic longitudinal axis 18 of the entire apparatus. Body portion 11 includes a knurled section 19.

A threaded post receptacle end cap 20 is a part of the preferred embodiment of the present invention, although it is not necessary that this structure be used in order to practice the most important elements of either the apparatus or method of construction of the present invention. Receptacle post 20 includes a shaft portion 21 which is threaded over a segment 22 of its length. This expands to a first body portion 25, which in turn expands to a second body portion 26 of the receptacle end plug. Second portion 26 includes knurling 27 in the preferred embodiment.

Figure 2:
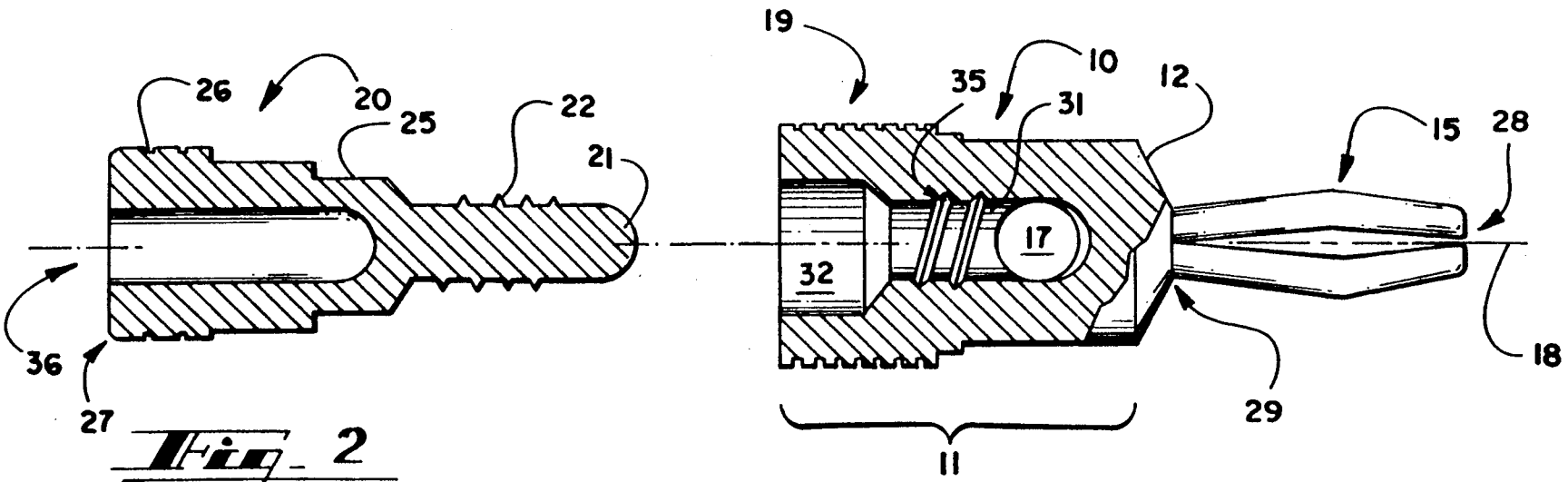
FIG. 2 is a side elevational view in a section cut in a plane passing through the longitudinal axis of the preferred embodiment taken along section line 2—2' shown in FIG. 1.

As may be seen in FIGS. 1 and 2, elongated tip 15 consists of four tangs extending from an exemplary first end shown at 28 to a second end shown at 29 at which the tangs join shoulder portion 12. Tangs are bent such that the distance measure between an outer surface of each of the tangs 16 and longitudinal axis 18 has a maximum value substantially at the mid-point of the distance between ends 28 and 29, as indicated by dashed line 30 in FIG. 1. The tangs surround a hollow bore through which longitudinal axis 18 passes.

Figure 3B:
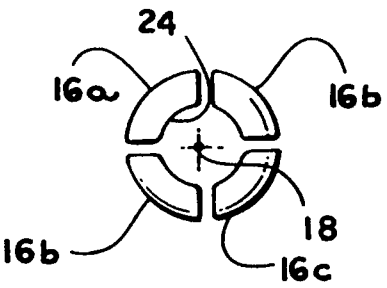
FIG. 3B is a front elevational view of the tip end of the elongated tip portion of the preferred embodiment.
Figure 3A:
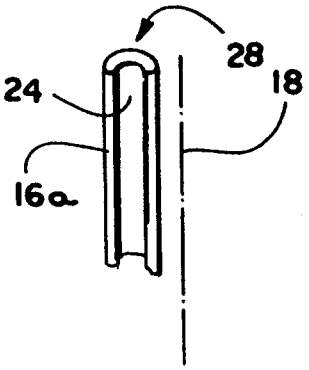
FIG. 3A is a detail of the tip end of one of the tangs of the preferred embodiment of the present invention.

FIG. 3A shows a detail of tip end 28 of a representative tang 16 as used in the preferred embodiment. The distal end 28 of representative tang 16*a* is slightly rounded due to the action of the bell shaped surface of the special forming tool described hereinbelow. Each tang also exhibits an arcuate concave inner surface, as shown at 24, which results from the longitudinal tapping of the shaft of the slug along longitudinal axis 18 as described hereinabove.

Turning next to FIG. 2, the purpose of receptacle end plug 20 may be appreciated more readily from the section view of FIG. 2. FIG. 2 is a section shown taken along line 2—2′ in FIG. 1, and the plane of the section passes through longitudinal axis 18. The interior of banana plug 10 includes a bored hole having a first section 31 of a first characteristic diameter and a second section 32 having a larger second characteristic diameter. A portion shown at 35 of first section 31 of the interior bore is threaded.

As may be seen in FIG. 2, radial hole 17 extends into the interior of first portion 31 of the longitudinal interior bore in banana plug 10 and is tapped so that it reaches at least the far wall of bore section 31 as viewed in FIG. 2.

Shaft 21 of rear receptacle cap 20 mates with longitudinal bore section 31 when same is inserted into the rear of banana plug 10 along longitudinal axis 18. Threaded portion 22 of shaft 21 mates with threaded portion 35 of interior bore 31 so that rear receptacle plug 20 may be screwed in and tightened down on banana plug 10. In the preferred embodiment hole 17 is sized to accept a relatively large gauge of wire or another banana plug or solid connector post for making additional electrical connections to the apparatus to which elongated tip portion 15 is connected. When an electrical conductor is inserted into hole 17, rear receptacle plug 20 acts as a set screw to tighten down and lock onto the conductor inserted in hole 17. Portion 25 of rear plug 20 becomes journaled in bore portion 32 in the interior of banana plug 10 when the latter is inserted into the former.

Knurled portion 19 of banana plug 10 and knurled portion 26 of rear receptacle plug 20 assist the user in a conventional manner of gripping same in order to manipulate the apparatus.

A longitudinal bore indicated at 36 is tapped into the rear end of rear end plug 20. This is sized so as to accept tip portion of another banana plug so that multiple banana plugs may be connected in a daisy chain fashion.

As noted hereinabove in the Background and Summary of the Invention sections, the main advantages of banana plug 10 of the present invention lie in the characteristics of elongated tip portion 15. In particular, tip 15 of the present invention provides better electrical contact capable of handling greater current densities at a lower resistance than typical banana plug structures of the prior art. Additionally, the spring and resistance to fatigue characteristics of a banana plug constructed according to the present invention are superior to those of prior art plugs. Lastly, the present invention produces a banana plug that has these improvements over the prior art yet is cheaper to manufacture since it does not involve separate steps of forming crossed strips of metal around an elongated cylindrical shaft and fastening some, normally by welding the ends of the strips to the shoulder portion of a plug.

The preferred method of construction of the present invention is what leads to the confluence of these advantageous features at a reduced cost as contrasted to the prior art.

The method of constructing banana plug 10 of the preferred embodiment is as follows. The method begins with starting materials of a solid slug (not shown in the drawing figures) preferably made of brass. Conventional milling steps are executed to cut away portions of the slug to form an initial solid segment corresponding to elongated tip 15 as well as tapered shoulder portion 12 and body portion 11. When this step is completed, the metallic portion corresponding to elongated tip 15 is solid and cylindrical.

A longitudinal bore is tapped along longitudinal axis 18 through substantially the entire length of tip portion 15. This forms elongated tip portion 15 in the form of a hollow cylinder.

Next, two milling steps are performed to make two orthogonal axial cuts in tip portion 15 between tip end 28 and shoulder end 29 of the tip. The arrangement of the cutting tool may be appreciated from inspection of detailed FIG. 3B which shows tip end 28, as viewed looking down longitudinal axis 18 toward shoulder end 29. While two cuts are preferable, any number of cuts may be made in methods embodying the present invention, limited only by the available metal, the width of the blade, and the expense the manufacturer is willing to tolerate.

Figure 4:
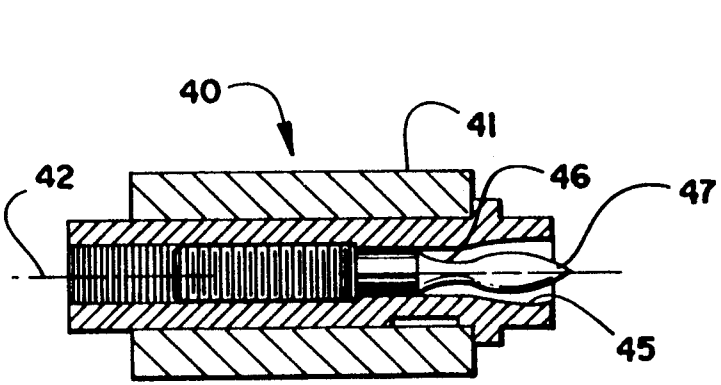
FIG. 4 is an elevational section view of a special crimping tool used in the preferred embodiment of the method of construction of the present invention.

FIG. 4 shows a special bell shaped spreading and crimping tool 40 in the preferred embodiment of the method of construction of the present invention. The tool includes a cylindrical outer surface 41. A characteristic longitudinal axis 42 of tool 40 is shown. Tool 40 is bilaterally symmetrical along any plane passing through longitudinal axis 42. Thus, it will be appreciated that it is, in the common vernacular, round.

A continuous toroidal scooped out section is formed in the interior of tool 40 as shown at 45. This line continues to a shaft portion 46 having a slightly bulbous head 47 at the distal end thereof.

Figure 5B:
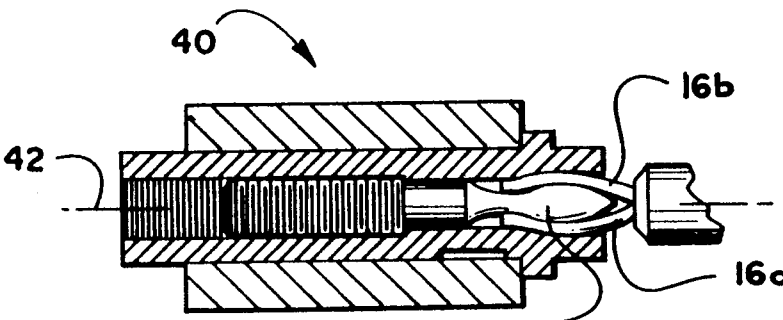
FIGS. 5A and 5B illustrate use of the tool depicted in FIG. 4 during certain steps of the preferred embodiment of the method of construction of the present invention.
Figure 5A:
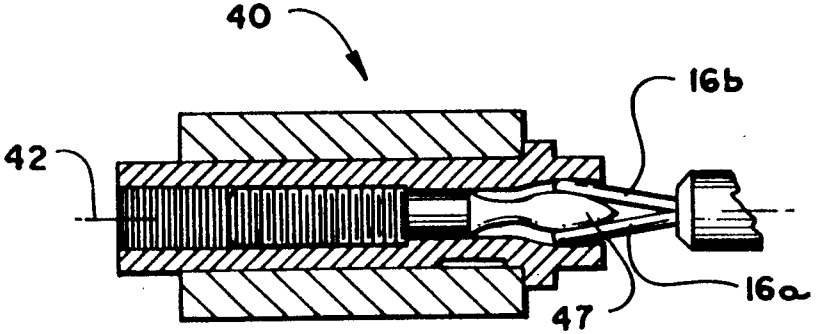

FIGS. 5A and 5B show two steps in the formation of elongated tip 15 in the preferred embodiment. Once the cuts are made in the elongated portion through longitudinal axis 18, the heretofore machined slug is secured by an appropriate gripping device, and spreading and crimping tool 40 is inserted along longitudinal axis 18 into the bored hole at tip end 28 (FIG.1).

Bulbous head 47 spreads tangs 16, as shown by the spreading of exemplary 16*a* and 16*b* in FIG. 5A. The tool continues to be forced along longitudinal axis 18 to the point is reached, which is illustrated in FIG. 5A, at which the distal ends of tangs 16*a* and 16*b* contact toroidal surface 45.

As may be seen by inspection of FIG. 5A, the tips of tangs 16 are forced by the geometry of surface 45 toward longitudinal axis 42 of the special tool as insertion of the tool continues. The tool is forced further down the bore of tip portion 15 until the apparatus assumes the geometry shown in FIG. 5B at which the tips of tangs 16 engage the upper portion of shaft 46 and are crimped over to form the crimped ends of the tangs as illustrated in detailed FIG. 3A.

Next, spreading and crimping tool 40 is removed. When this step is completed, the tangs are spread apart. The final step in fabrication of elongated tip 15 is to urge the tip ends of tangs 16 together and insert the tip into a typical banana plug receptacle for final shaping.

The results of these steps provide banana plug with elongated tip 15 having a structure as illustrated in FIGS. 1 and 2 as described herein which has the advantageous characteristics described hereinabove as contrasted to the prior art.

Other steps in completion of the preferred embodiment are conventional and will not be described in detail herein. It is sufficient to note that conventional machining steps are used to tap bore portions 31 and 32 in banana plug 10 and to provide threaded portion 35. Similarly, a conventional drilling step is used to tap radial hole 17. Likewise, conventional methods are used to provide threaded section 22 on shaft 21 of receptacle plug 20 and to tap receptacle bore 36 in the rear end thereof. Conventional steps and apparatus are used to create knurled portions 19 and 26 on banana plug 10 and receptacle end plug 20.

From the foregoing description of the preferred embodiment of the apparatus and method and construction of the present invention, those skilled in the art will appreciate that a banana plug having a tip with the superior characteristics described hereinabove is provided. As noted hereinabove, it is preferable to use a solid slug of brass as the starting materials for construction. While a significant number of machining and milling steps are required, the inventor of the present invention has discovered that it is still cheaper to manufacture these superior plugs from a solid piece of metal as opposed to the conventional provision of malleable conductive cross pieces of metal which are folded over and spot welded to the shoulders of prior art banana plugs.

From the foregoing, it will be appreciated that the method and apparatus of the present invention overcome the drawbacks of the prior art cited hereinabove. While the preferred embodiments of both the method and apparatus, which the inventor believes are the mode of making and using same, have been described in detail, other embodiments of both the method and apparatus of the present invention may suggest themselves to those skilled in the art. Therefore, the scope of the present invention is to be limited only by the claims below.

I claim:

1. A method of constructing an electrical connector comprising the steps of:

providing a slug;

shaping said slug into a cylinder having a characteristic longitudinal axis;

removing metal from a first end of said cylinder to form an elongated tip and a body portion adjoining said elongated tip;

boring into said elongated tip along said longitudinal axis to provide a hollow bore;

forming a multiplicity of tangs around said hollow bore in said elongated tip by making a plurality of cuts through said elongated tip along said longitudinal axis;

providing an insertion tool comprising a generally bell-shaped member and a shaft member attached to the concave surface of bell-shaped member at a first end and having a tapered tip at a second end of said chart member;

inserting said tapered tip of said insertion tool into said hollow bore in said elongated tip such that, as said tool is inserted, said tapered tip forces said multiplicity of tangs apart and said bell-shaped member subsequently forces said tangs back together; and withdrawing said insertion tool.

2. The method of constructing an electrical connector as recited in claim 1 further comprising the steps of:

providing a finishing tool comprising a member with a bore hole having a diameter slightly larger than the diameter of said elongated tip;

inserting said elongated tip into said bore hole in said finishing tool such that said tangs are urged toward said longitudinal axis; and withdrawing said elongated tip from said finishing tool.

3. The method of constructing an electrical connector as recited in claim 1 wherein said plurality of cuts are made in planes which intersect at a right angle.

4. The method of constructing an electrical connector as recited in claim 1 wherein the step of boring into said elongated tip further includes boring into said elongated tip along the entire length of said elongated tip.

5. The method of constructing an electrical connector as recited in claim 1 wherein said slug is composed of brass.

6. The method of constructing an electrical connector as recited in claim 1 further including the step of boring a radial hole in said body portion extending at least to said longitudinal axis.

7. The method of constructing an electrical connector as recited in claim 1 further including the step of knurling at least part of the surface of said body portion.

8. The method of constructing an electrical connector as recited in claim 1 further comprising a step of boring a longitudinal hole extending from a rear end of said body portion along said longitudinal axis.

9. The method of constructing an electrical connector as recited in claim 8 wherein said longitudinal hole is bored colinear with said longitudinal axis.

10. The method of constructing an electrical connector as recited in claim 9 wherein said step of boring a longitudinal hole further comprising the substeps of:

(a) forming a first longitudinal hole segment of a first longitudinal hole diameter proximate to said plurality of tangs; and (b) forming a second longitudinal hole segment of a second longitudinal hole diameter proximate to said rear end of said body portion, said second diameter being greater than said first diameter.

11. The method of constructing an electrical connector as recited in claim 10 further including the step of threading the interior of said first longitudinal hole segment.

* * * * *